US010135203B2

(12) United States Patent
Lyu

(10) Patent No.: US 10,135,203 B2
(45) Date of Patent: Nov. 20, 2018

(54) CONNECTION METHOD OF RF CABLE END CONNECTOR AND COAXIAL CABLE AND INTERNAL TERMINAL USED THEREOF

(71) Applicant: HARUMOTO TECHNOLOGY (SHEN ZHEN) CO., LTD., Shenzhen (CN)

(72) Inventor: Yi-Gen Lyu, Shenzhen (CN)

(73) Assignee: HARUMOTO TECHNOLOGY (SHEN ZHEN) CO., LTD., Shenzhen (CN)

( * ) Notice: Subject to any disclaimer, the term of this patent is extended or adjusted under 35 U.S.C. 154(b) by 0 days.

(21) Appl. No.: 15/635,584

(22) Filed: Jun. 28, 2017

(65) Prior Publication Data

US 2018/0006411 A1 Jan. 4, 2018

(30) Foreign Application Priority Data

Jul. 1, 2016 (TW) ..... 105121050 A

(51) Int. Cl.

| | |
|---|---|
| ***H01R 9/05*** | (2006.01) |
| ***H01R 24/38*** | (2011.01) |
| ***H01R 24/40*** | (2011.01) |
| *H01R 4/18* | (2006.01) |
| *H01R 4/02* | (2006.01) |
| *H01R 103/00* | (2006.01) |
| *H01R 24/44* | (2011.01) |

(52) U.S. Cl.

CPC ..... *H01R 24/38* (2013.01); *H01R 4/187* (2013.01); *H01R 9/0518* (2013.01); *H01R 24/40* (2013.01); *H01R 4/02* (2013.01); *H01R 4/023* (2013.01); *H01R 4/184* (2013.01); *H01R 24/44* (2013.01); *H01R 2103/00* (2013.01)

(58) Field of Classification Search

CPC ..... H01R 4/02; H01R 24/38; H01R 24/44
USPC ..... 439/582, 585, 578, 626, 581, 394
See application file for complete search history.

(56) References Cited

U.S. PATENT DOCUMENTS

| | | | | |
|---|---|---|---|---|
| 5,569,049 | A * | 10/1996 | Tatebe | H01R 24/50 439/394 |
| 6,305,980 | B2 * | 10/2001 | Ko | G01N 33/0009 439/582 |
| 6,361,383 | B1 * | 3/2002 | Ko | H01R 9/0527 439/582 |
| 6,371,806 | B1 * | 4/2002 | Ko | H01R 9/0518 439/585 |
| 6,503,100 | B2 * | 1/2003 | Yamane | H01R 4/023 439/582 |
| 6,739,907 | B2 * | 5/2004 | Kuroda | H01R 4/023 439/582 |

(Continued)

*Primary Examiner* — Tho D Ta
*Assistant Examiner* — Peter G Leigh
(74) *Attorney, Agent, or Firm* — Chun-Ming Shih

(57) ABSTRACT

A connection method of an RF cable end connector and a coaxial cable and an internal terminal used thereof are provided. An insulator is formed outside a body of the internal terminal by embedded molding, making the internal terminal have a composite structure integrated with the insulator. The internal terminal can be connected to the coaxial cable by, for example, clamping. This allows connection between the RF cable end connector and the coaxial cable to be easily accomplished by automatic processes, thereby reducing fabrication costs of RF cable end connector jumpers.

5 Claims, 7 Drawing Sheets

(56) References Cited

U.S. PATENT DOCUMENTS 6,790,082 B2 * 9/2004 Obayashi ..... H01R 9/0518 439/582
7,025,598 B2 * 4/2006 Ikeda ..... H01R 24/50 439/582
7,351,067 B2 * 4/2008 Chen ..... H01R 9/0518 439/581
7,465,191 B1 * 12/2008 Ho ..... H01R 9/0518 439/394
7,510,434 B2 * 3/2009 Hantsch ..... H01P 1/2007 439/578
7,762,841 B2 * 7/2010 Ho ..... H01R 9/0518 439/582
7,909,645 B2 * 3/2011 Mulfinger ..... H01R 9/0518 439/578
8,137,134 B1 * 3/2012 Chang ..... H01R 9/0518 439/582
8,317,540 B2 * 11/2012 Chen ..... H01R 9/0518 439/582
8,636,542 B2 * 1/2014 Funahashi ..... H01R 24/545 439/582
8,668,521 B2 * 3/2014 Sasaki ..... H01R 24/38 439/582
8,734,179 B2 * 5/2014 Tsai ..... H01R 13/516 29/857
8,876,552 B2 * 11/2014 Taguchi ..... H01R 24/54 439/582
2010/0087091 A1 * 4/2010 Chen ..... H01R 4/48 439/578
2012/0164880 A1 * 6/2012 Chiu ..... H01R 9/0518 439/582
2015/0364843 A1 * 12/2015 Yamauchi ..... H01R 9/053 439/394
2016/0164199 A1 * 6/2016 Hashimoto ..... H01R 24/38 439/578

* cited by examiner

CONNECTION METHOD OF RF CABLE END CONNECTOR AND COAXIAL CABLE AND INTERNAL TERMINAL USED THEREOF

CROSS-REFERENCE TO RELATED APPLICATIONS

This application claims the priority of Republic of China Patent Application No. 105121050 filed on Jul. 1, 2016, in the State Intellectual Property Office of the R.O.C., the disclosure of which is incorporated herein by reference.

BACKGROUND OF THE INVENTION

Field of the Invention

The invention relates to connection methods of RF cable end connectors and coaxial cables and internal terminals used thereof, and more particularly, to a connection method of an RF cable end connector and a coaxial cable and an internal terminal used thereof, which may achieve automatic production of RF cable end connector jumpers and thereby effectively reduce fabrication costs thereof.

Descriptions of the Related Art

It is known that RF cable end connector jumpers composed of RF cable end connectors and coaxial cables have been widely used in high frequency signal transmission for electronic devices such as GPS, GSM, TV, RADIO and so on. The RF cable end connectors are designed with various structural configurations according to their applications, but most of them include central conductor terminals and outer conductor terminals, which are separately provided. In such a case, however, how to fix relative positions of the central conductor terminals and the outer conductor terminals is usually an issue needed to be addressed when fabricating the RF cable end connectors.

Moreover, the various structural configurations of the RF cable end connectors include, for example, FAKRA connectors applied in automotive/mobile communication equipment and telecommunications. For the FAKRA connectors, connecting FAKRA cable end connectors and coaxial cables to form FAKRA cable end connector jumpers is usually accomplished by a soldering technique that bonds metallic conductors of the FAKRA cable end connectors to metallic conductors of the coaxial cables. However, the soldering technique is not favorable for automatic processes, making fabrication costs of the FAKRA cable end connector jumpers not able to be reduced.

Besides the FAKRA connectors, other structural configurations of the RF cable end connectors also adopt the soldering technique for cable bonding, and thus their bonding with coaxial cables cannot be performed by fully automatic processes. This similarly leads to high fabrication costs of the RF cable end connector jumpers. How to solve the above problems is thus an important task in the art.

SUMMARY OF THE INVENTION

In view of the above drawbacks in the conventional technology, a primary object of the invention is to provide an internal terminal for an RF cable end connector, for clamping a coaxial cable and electrically contacting a casing terminal, the coaxial cable including a central conductor, an inner insulation layer, an outer conductor and an outer insulation layer, with the central conductor and the outer conductor being separated by the inner insulation layer, the internal terminal including: an internal terminal body including: a central conductor terminal part having a central conductor clamp corresponding to the central conductor of the coaxial cable and for clamping the central conductor; and an outer conductor terminal part having an outer conductor clamp, an outer insulation layer clamp and a casing terminal contact, wherein the outer conductor clamp corresponds to the outer conductor of the coaxial cable and is for clamping the outer conductor, the outer insulation layer clamp corresponds to the outer insulation layer of the coaxial cable and is for clamping the outer insulation layer, and the casing terminal contact is for electrically contacting the casing terminal; and an insulator integrated with the internal terminal body by embedded molding, and exposing the central conductor clamp, the outer conductor clamp, the outer insulation layer clamp and the casing terminal contact.

The invention is further to provide a connection method of an RF cable end connector and a coaxial cable, using the internal terminal said above. The connection method of an RF cable end connector and a coaxial cable includes the steps of: placing the central conductor, the outer conductor and the outer insulation layer of the coaxial cable into the corresponding clamps exposed from the insulator, and allowing the central conductor clamp to clamp the central conductor, the outer conductor clamp to clamp the outer conductor, and the outer insulation layer clamp to clamp the outer insulation layer; and providing the casing terminal and fixing it to the insulator to cover a contact portion of the central conductor, and electrically contacting the casing terminal with the casing terminal contact.

Moreover, the invention is further to provide an internal terminal for an RF cable end connector, for bonding a coaxial cable and electrically contacting a casing terminal, the coaxial cable including a central conductor, an inner insulation layer and an outer conductor, with the central conductor and the outer conductor being separated by the inner insulation layer, the internal terminal including: an internal terminal body including: a central conductor terminal part for bonding the central conductor of the coaxial cable; and an outer conductor terminal part for bonding the outer conductor of the coaxial cable and having a casing terminal contact for electrically contacting the casing terminal; and an insulator integrated with the central conductor terminal part and the outer conductor terminal part by embedded molding, and exposing a portion of the central conductor terminal part for bonding the central conductor, a portion of the outer conductor terminal part for bonding the outer conductor, and the casing terminal contact.

The invention is further to provide a connection method of an RF cable end connector and a coaxial cable, using the internal terminal said above. The connection method of an RF cable end connector and a coaxial cable includes the steps of placing the central conductor and the outer conductor of the coaxial cable within the insulator, they are bonded to the central conductor terminal part and the outer conductor terminal part of the internal terminal body respectively, and providing the casing terminal and fixing it to the insulator to cover a contact portion of the central conductor, and electrically contacting the casing terminal with the casing terminal contact.

Compared to the conventional technology, the invention is to provide a connection method of an RF cable end connector and a coaxial cable and an internal terminal used thereof, which have an insulator formed outside a body of the internal terminal by embedded molding to fix relative positions of a central conductor terminal part and an outer conductor terminal part, such that the internal terminal has a composite structure integrated with the insulator. This is thereby to solve the problem of having difficulty in fixing relative positions of central conductor terminals and outer conductor terminals during fabrication of conventional RF cable end connectors. Moreover, the RF cable end connector of the invention may be connected to the coaxial cable by clamping and this connection can be performed in fully automatic processes, such that the problem of not able to reduce fabrication costs of conventional RF cable end connector jumpers can be solved.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
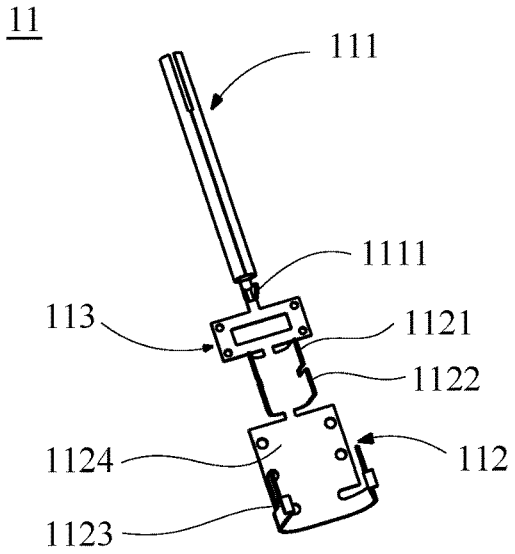
FIG. 1 is a schematic diagram of a body of a single-piece internal terminal according to an embodiment of the invention.
Figure 2:
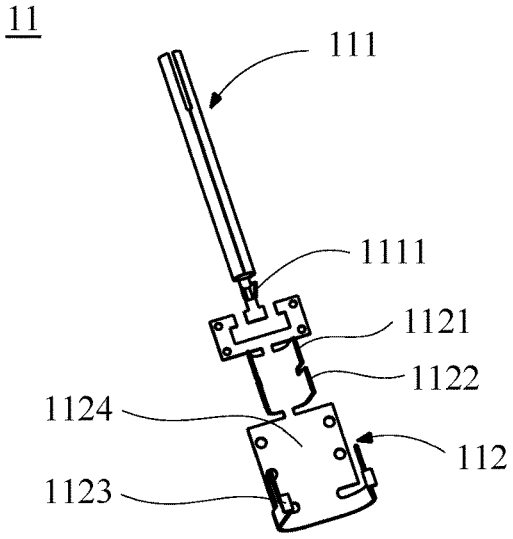
FIG. 2 is a schematic diagram of a body of a dual-piece internal terminal according to the invention.

Embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like components.

Technical features of the invention may be disclosed with reference to FIGS. 1 to 13.

The invention provides a connection method of an RF cable end connector and a coaxial cable and an internal terminal used thereof. The internal terminal 1 is used for bonding the coaxial cable 2 and electrically contacting a casing terminal 3 so as to connect the RF cable end connector and the coaxial cable 2 and achieve automatic production of RF cable end connector jumpers in a way of reducing fabrication costs thereof. The coaxial cable 2 includes a central conductor 21, an inner insulation layer 22, an outer conductor 23 and an outer insulation layer 24. The inner insulation layer 22 separates the central conductor 21 from the outer conductor 23, and the outer insulation layer 24 is provided outside the outer conductor 23 and protects the outer conductor 23.

First Embodiment

Figure 13:
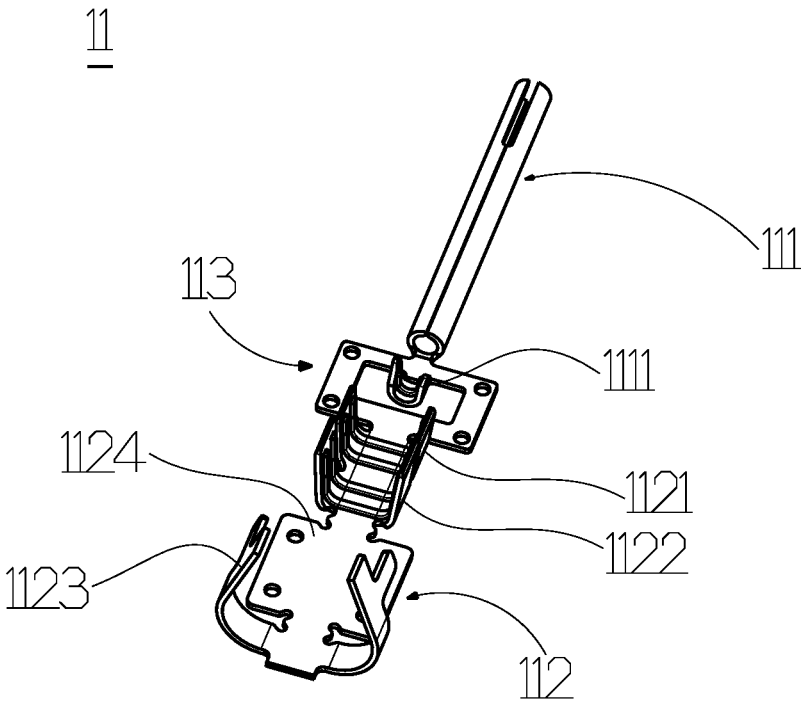
FIG. 13 is a schematic diagram of a body of a single-piece internal terminal according to another embodiment of the invention.

In this embodiment, the internal terminal 1 includes an internal terminal body 11 and an insulator 12. The internal terminal body 11 includes a central conductor terminal part 111, an outer conductor terminal part 112 and a connection part 113. The central conductor terminal part 111 has a central conductor clamp 1111 for clamping the central conductor 21. As shown in FIG. 1, the central conductor clamp 1111 can be provided between the central conductor terminal part 111 and the connection part 113 but is not limited to this arrangement. Alternatively, for example, as shown in FIG. 13, the central conductor clamp 1111 may be extended to a middle portion of the connection part 113. The outer conductor terminal part 112 has an outer conductor clamp 1121, an outer insulation layer clamp 1122 and a casing terminal contact 1123. The outer conductor clamp 1121 is used for clamping the outer conductor 23. The outer insulation layer clamp 1122 is used for clamping the outer insulation layer 24. The casing terminal contact 1123 is used for electrically contacting the casing terminal 3 to form a shielding loop enclosing the central conductor terminal part 111, which acts as a shielding structure similar to a coaxial cable to prevent surrounding electromagnetic coupling from interfering with signal transmission of the central conductor terminal part 111. The insulator 12 is fixed outside the internal terminal body 11 and integrally formed with the internal terminal body 11 by embedded molding, making the internal terminal 1 have a composite structure integrated with the insulator 12, and the insulator 12 has an open space for exposing the central conductor clamp 1111, the outer conductor clamp 1121, the outer insulation layer clamp 1122 and the casing terminal contact 1123. The connection part 113 integrally connects the central conductor terminal part 111 and the outer conductor terminal part 112 together in a manner that, when the insulator 12 is fixed to the internal terminal body 11, the central conductor terminal part 111 and the outer conductor terminal part 112 are also fixed, thereby helping clamp the internal terminal 1 to the coaxial cable 2.

Figure 11:
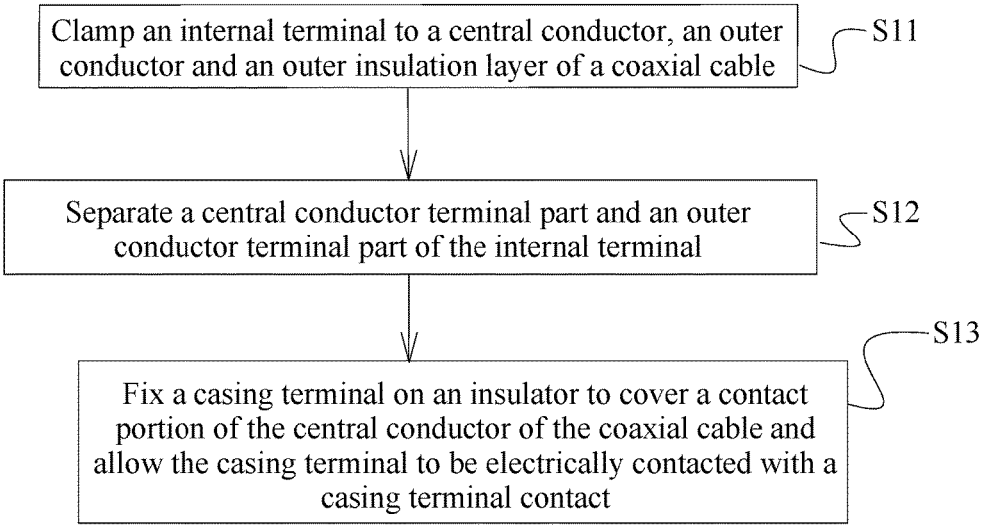
FIG. 11 is a flowchart of a connection method of an RF cable end connector and a coaxial cable according to an embodiment of the invention.

The connection method of the RF cable end connector and the coaxial cable in this embodiment is shown in FIG. 11. Referring to FIG. 11, first, the central conductor 21, the inner insulation layer 22, the outer conductor 23 and the outer insulation layer 24 of the coaxial cable 2 are placed in the open space of the insulator 12 at positions corresponding to the clamps exposed in the open space. Then, step S11 is executed in which the central conductor 21 of the coaxial cable 2 is clamped to the central conductor clamp 1111 of the central conductor terminal part 111 of the internal terminal body 11, and the outer conductor 23 and the outer insulation layer 24 of the coaxial cable 2 are respectively clamped to the outer conductor clamp 1121 and the outer insulation layer clamp 1122 of the outer conductor terminal part 112 of the internal terminal body 11, so as to accomplish connection between the internal terminal 1 and the coaxial cable 2. Then step S12 is executed in which a shear force is applied on the connection part 113 to separate the central conductor terminal part 111 from the outer conductor terminal part 112 of the internal terminal body 11, in order to prevent electrical short circuit between the central conductor terminal part 111 and the outer conductor terminal part 112. The order of executing the steps is not limited to the above described. Alternatively, step S12 can be performed first as the insulator 12 has fixed the central conductor terminal part 111 and the outer conductor terminal part 112. After the central conductor terminal part 111 is electrically separated from the outer conductor terminal part 112, step S11 is executed for clamping the coaxial cable 2 to the internal terminal 1.

Figure 3:
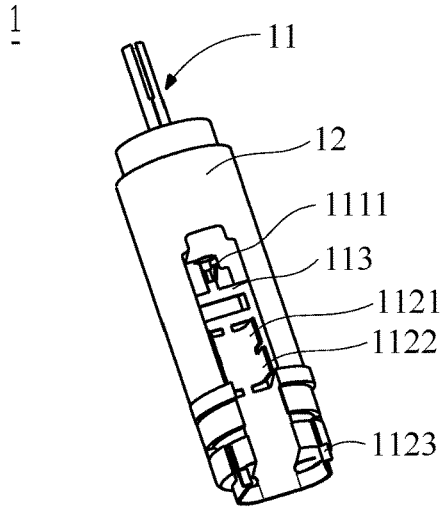
FIG. 3 is a schematic diagram showing the body of the internal terminal outside formed with an insulator according to the invention.
Figure 4:
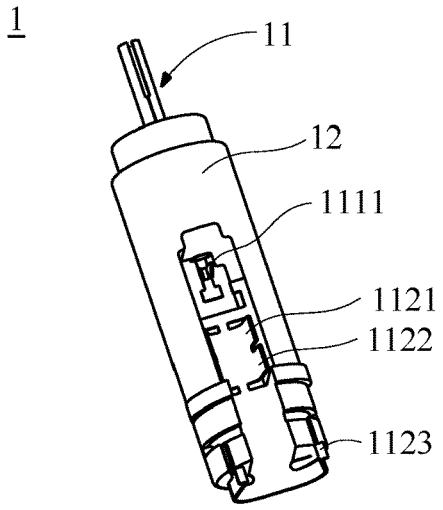
FIG. 4 is a schematic diagram showing a central conductor terminal part being separated from an outer conductor terminal part of the body of the internal terminal after the insulator is formed according to the invention.
Figure 5:
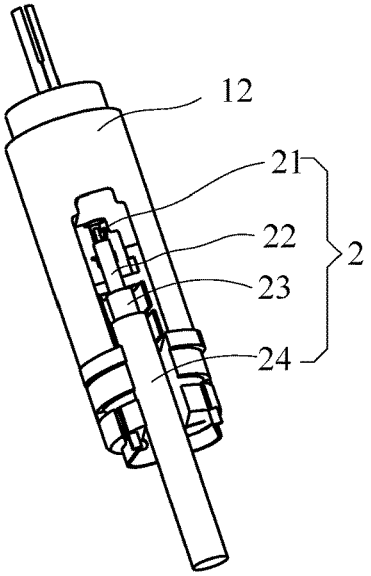
FIG. 5 is a schematic diagram showing before clamping, a coaxial cable having an end inserted into the insulator according to the invention.
Figure 6:
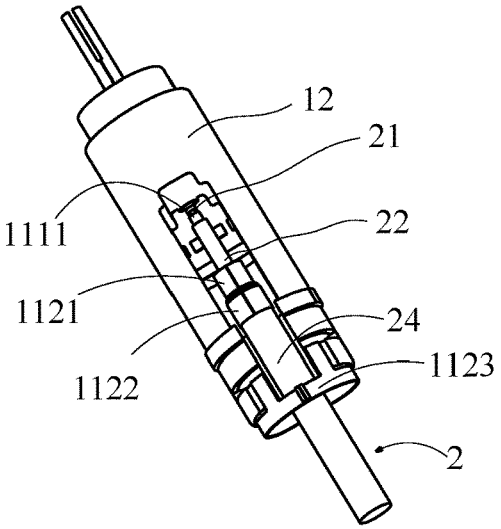
FIG. 6 is a schematic diagram showing the body of the internal terminal being clamped to the coaxial cable according to the invention.
Figure 7:
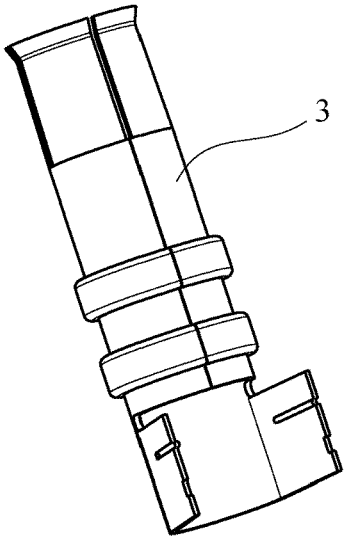
FIG. 7 is a schematic diagram of a casing terminal of a FAKRA connector according to an embodiment of the invention.
Figure 8:
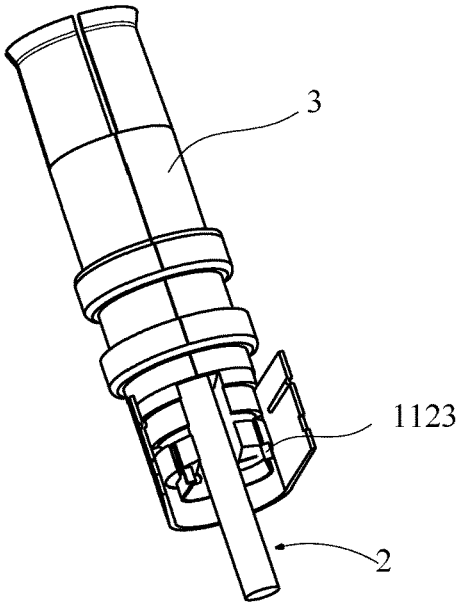
FIG. 8 is a schematic diagram showing the casing terminal and an outer conductor terminal part that have not been electrically contacted in the FAKRA connector according to the embodiment of the invention.
Figure 9:
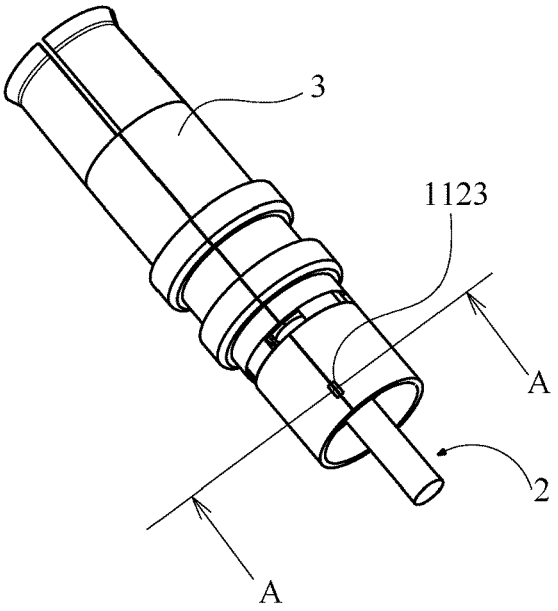
FIG. 9 is a schematic diagram showing the casing terminal and the outer conductor terminal part that have been electrically contacted in the FAKRA connector according to the embodiment of the invention.
Figure 10:
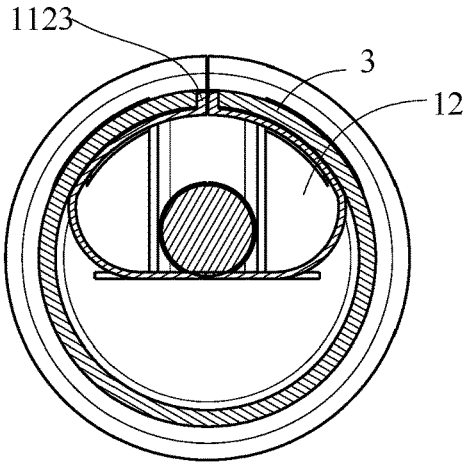
FIG. 10 is a cross-sectional view of FIG. 9 along line AA.

Then, the casing terminal 3 is provided and step S13 is executed. The casing terminal 3 is fixed on the insulator 12 to cover the central conductor 21 clamped to the internal terminal 1. The central conductor 21 is further electrically contacted with the casing terminal contact 1123 by a bonding technique such as crimping, clamping, soldering or IDC, so as to completely form the RF cable end connector and also accomplish connection between the RF cable end connector and the coaxial cable 2. This step can be included in automatic processes, thereby reducing fabrication costs of RF cable end connector jumpers. As shown in FIG. 3, the casing terminal contact 1123 of this embodiment is shaped like a clip protruded from the insulator 12 and extended along an outer surface of the insulator 12, such that when the casing terminal 3 is electrically contacted with the casing terminal contact 1123 (by the bonding technique such as crimping, clamping, soldering or IDC), it abuts against the insulator 12 that is able to retain the shape of the casing terminal contact 1123 and assure the electrical contact between the casing terminal contact 1123 and the casing terminal 3, as shown in FIG. 10.

It should be noted that, the casing terminal contact 1123 may further be formed with a material belt attaching portion on a side thereof for attaching the internal terminal body 11 to a material belt. This helps fix the insulator 12 to the internal terminal body 11 by embedded molding in an automatic manner, and also helps connect the internal terminal 1 and the coaxial cable 2 in an automatic manner. In order to assure the electrical contact between the casing terminal contact 1123 and the casing terminal 3, the casing terminal contact 1123 may be separate from the outer insulation layer clamp 1122, such that the outer conductor terminal part 112 may further be formed with a joint portion 1124 for connecting the casing terminal contact 1123 and the outer insulation layer clamp 1122. As shown in FIG. 1, the joint portion 1124 of this embodiment has, but not limited to, a plate-like structure.

Second Embodiment

This embodiment differs from the first embodiment primarily in that, the internal terminal of this embodiment has its internal terminal body 11 composed of two individual pieces: central conductor terminal part 111 and outer conductor terminal part 112. An insulator is formed outside the internal terminal body 11 by embedded molding and fixes relative positions of the central conductor terminal part 111 and the outer conductor terminal part 112, making the internal terminal have a composite structure integrated with the insulator. This thereby solves the problem of not able to fix relative positions of central conductor terminals and outer conductor terminals during fabrication of conventional RF cable end connectors. In this embodiment, the central conductor terminal part 111 and the outer conductor terminal part 112 can be two separate metallic parts. Thus, the connection method of the RF cable end connector and the coaxial cable in this embodiment does not require step S12 for electrically separating the central conductor terminal part 111 from the outer conductor terminal part 112 as that performed in the first embodiment.

Third Embodiment

Figure 12:
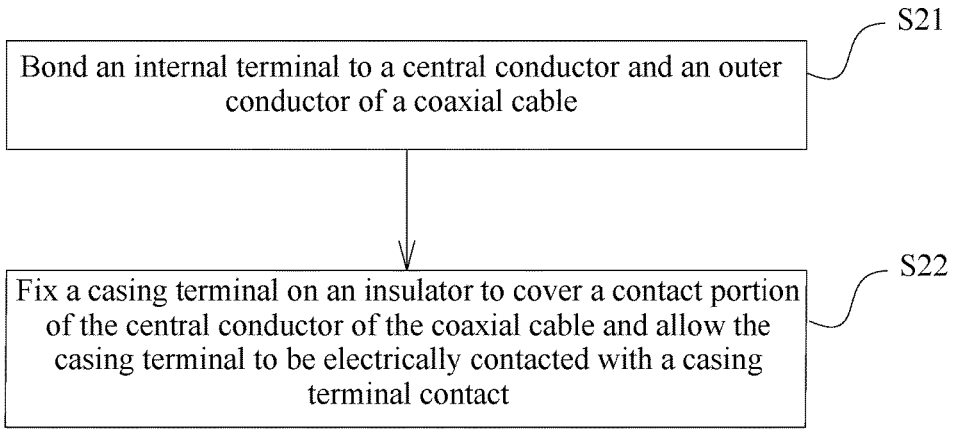
FIG. 12 is a flowchart of a connection method of an RF cable end connector and a coaxial cable according to another embodiment of the invention.

This embodiment differs from the first embodiment primarily in that, the internal terminal body of this embodiment has its central conductor terminal part and outer conductor terminal part being electrically contacted with the central conductor and the outer conductor of the coaxial cable respectively by a bonding technique such as crimping, soldering or ICD but excluding clamping. The connection method of the RF cable end connector and the coaxial cable in this embodiment thus as shown in FIG. 12 first executes step S21 in which when the central conductor and the outer conductor of the coaxial cable are placed within the insulator, they are bonded to the central conductor terminal part and the outer conductor terminal part of the internal terminal body respectively. Then step S22 is executed to provide the casing terminal and fix it on the insulator to cover a contact portion of the central conductor, and electrically contact the casing terminal with the casing terminal contact.

Therefore, the invention provides a connection method of an RF cable end connector and a coaxial cable and an internal terminal used thereof, which have an insulator formed outside a body of the internal terminal by embedded molding to fix relative positions of a central conductor terminal part and an outer conductor terminal part, such that the internal terminal has a composite structure integrated with the insulator. This is thereby to solve the problem of having difficulty in fixing relative positions of central conductor terminals and outer conductor terminals during fabrication of conventional RF cable end connectors. Moreover, the RF cable end connector of the invention may be connected to the coaxial cable by clamping and such a connection can be performed in an automatic manner, thereby reducing fabrication costs of RF cable end connector jumpers.

The examples above are only illustrative to explain principles and effects of the invention, but not to limit the invention. It will be apparent to those skilled in the art that modifications and variations can be made without departing from the spirit and scope of the invention. Therefore, the protection range of the rights of the invention should be as defined by the appended claims.

What is claimed is:

1. An internal terminal for an RF cable end connector, for clamping a coaxial cable and electrically contacting a casing terminal, the coaxial cable including a central conductor, an inner insulation layer, an outer conductor and an outer insulation layer, with the central conductor and the outer conductor being separated by the inner insulation layer, the internal terminal including:

an internal terminal body including:

a central conductor terminal part having a central conductor clamp corresponding to the central conductor of the coaxial cable and for clamping the central conductor; and an outer conductor terminal part having an outer conductor clamp, an outer insulation layer clamp and a casing terminal contact, wherein the outer conductor clamp corresponds to the outer conductor of the coaxial cable and is for clamping the outer conductor, the outer insulation layer clamp corresponds to the outer insulation layer of the coaxial cable and is for clamping the outer insulation layer, and the casing terminal contact is for electrically contacting the casing terminal; and an insulator integrated with the internal terminal body by embedded molding, and exposing the central conductor clamp, the outer conductor clamp, the outer insulation layer clamp and the casing terminal contact, wherein the casing terminal contact is protruded from the insulator and extended along an outer surface of the insulator to electrically contact the casing terminal and abut against the insulator.

2. The internal terminal according to claim 1, wherein the internal terminal body further includes a connection part for connecting the central conductor terminal part and the outer conductor terminal part and exposed from the insulator.

3. The internal terminal according to claim 2, wherein the outer conductor terminal part further includes a joint portion for connecting the casing terminal contact and the outer insulation layer clamp.

4. A connection method of an RF cable end connector and a coaxial cable, using the internal terminal according to claim 1, the connection method including the steps of:

placing the central conductor, the outer conductor and the outer insulation layer of the coaxial cable into the corresponding clamps exposed from the insulator, and allowing the central conductor clamp to clamp the central conductor, the outer conductor clamp to clamp the outer conductor, and the outer insulation layer clamp to clamp the outer insulation layer; and providing the casing terminal and fixing it to the insulator to cover a contact portion of the central conductor, and electrically contacting the casing terminal with the casing terminal contact, wherein the internal terminal body further includes a connection part for connecting the central conductor terminal part and the outer conductor terminal part and exposed from the insulator, and the connection method further includes a step of applying a shear force on the connection part to separate the central conductor terminal part from the outer conductor terminal part.

5. The connection method according to claim 4, wherein the casing terminal is electrically contacted with the casing terminal contact by a bonding technique of crimping, clamping, soldering or IDC.

* * * * *